US008453812B2

(12) United States Patent
Xiao

(10) Patent No.: US 8,453,812 B2
(45) Date of Patent: Jun. 4, 2013

(54) FOLDING SPORT LUGGAGE

(76) Inventor: Zhuofan Xiao, Heshan (CN)

( * ) Notice: Subject to any disclaimer, the term of this patent is extended or adjusted under 35 U.S.C. 154(b) by 0 days.

(21) Appl. No.: 13/234,128

(22) Filed: Sep. 15, 2011

(65) Prior Publication Data

US 2012/0055750 A1 Mar. 8, 2012

Related U.S. Application Data

(63) Continuation of application No. PCT/CN2010/072909, filed on May 19, 2010.

(30) Foreign Application Priority Data

May 21, 2009 (CN) ..... 2009 2 0303441

(51) Int. Cl.
*A45C 7/00* (2006.01)
*A45C 5/14* (2006.01)

(52) U.S. Cl.
USPC ..... 190/18 A; 190/115; 190/102; 190/103; 190/1; 280/47.28

(58) Field of Classification Search
USPC ..... 180/47.28; 190/102, 1, 103, 18 A, 190/115
See application file for complete search history.

(56) References Cited

U.S. PATENT DOCUMENTS

| | | | | |
|---|---|---|---|---|
| 5,769,194 | A * | 6/1998 | Chang | 190/18 A |
| 6,604,617 | B2 * | 8/2003 | Davis et al. | 190/107 |
| 7,097,181 | B2 * | 8/2006 | Sadow | 280/37 |
| 7,588,254 | B2 * | 9/2009 | Anthony | 280/47.24 |
| 2008/0110711 | A1 * | 5/2008 | Coughlin | 190/9 |
| 2009/0114493 | A1 * | 5/2009 | Leung | 190/18 A |
| 2009/0321204 | A1 * | 12/2009 | Barkow et al. | 190/8 |
| 2010/0282555 | A1 * | 11/2010 | Tseng et al. | 190/103 |
| 2011/0247910 | A1 * | 10/2011 | Darvish et al. | 190/18 A |

* cited by examiner

*Primary Examiner* — Tri Mai
(74) *Attorney, Agent, or Firm* — Matthias Scholl P.C.; Matthias Scholl

(57) ABSTRACT

A folding sport luggage including a main luggage case and wheels equipped at the bottom of the case. The main luggage case includes a front portion and a rear portion. The rear portion of the main luggage case has a frame composed of side, back, and bottom panels and coated with a coating. The front portion of the main luggage case has a soft bag case extending from the frame of the main luggage case. The bottom panel can be folded and includes a folding front portion supporting the bottom of the soft bag case and a rear portion supporting the bosom of the frame of the main luggage case. With no items inside, the front portion of the luggage can be folded inwards to greatly reduce the space occupied by the sport luggage. Thus it is convenient to place and transport, with low cost.

1 Claim, 3 Drawing Sheets

FOLDING SPORT LUGGAGE

CROSS-REFERENCE TO RELATED APPLICATIONS

This application is a continuation of International Patent Application No. PCT/CN2010/072909 with an international filing date of May 19, 2010, designating the United States, now pending, and further claims priority benefits to Chinese Patent Application No. 200920303441.3 filed May 21, 2009. The contents of all of the aforementioned applications, including any intervening amendments thereto, are incorporated herein by reference.

BACKGROUND OF THE INVENTION

1. Field of the Invention

The invention relates to a sport luggage, and more particularly to a folding sport luggage.

2. Description of the Related Art

Conventional sport luggage, such as sport luggage for hockey and baseball equipment, usually has a crusty cover structure for providing more support to prevent items inside the sport luggage from being damaged by compression. Such sport luggage is generally large and inconvenient in transportation. Accordingly, the sport luggage may directly lead to increasing cost for shipment and delivery.

Further, conventional sport luggage may include devices for hanging towels. After removed from the luggage, the hanging device generally stands separately on the ground. Therefore, the hanging device provided with current sport luggage is inconvenient, easy to lose, and unreliable.

SUMMARY OF THE INVENTION

In view of the above-described problems, it is one objective of the invention to provide an easy-to-use folding sport luggage.

To achieve the above objectives, in accordance with one embodiment of the invention, there is provided a folding sport luggage comprising: a main luggage case comprising a front portion and a rear portion, the rear portion comprising a frame comprising a side panel, a back panel, and a bottom panel, the front portion comprising a soft bag case extending from the frame of the rear portion, the bottom panel comprising a folding structure comprising a folding front portion supporting the bottom of the soft bag case and a fixed rear portion supporting the bottom of the frame, and the fixed rear portion having wheels mounted below.

In a class of this embodiment, the folding front portion of the bottom panel folds inwards.

In a class of this embodiment, the folding front portion of bottom panel is equipped with an additional support.

In a class of this embodiment, the side panel of the frame narrows inwards and upwards.

In a class of this embodiment, an opposite side of the back panel of the main luggage case is equipped with two parallel support slats and a hanging rack hinged between the two support slats; the lower end of the hanging rack has a rotation structure and the upper end of the hanging rack connects with the main luggage case through a restraint string.

In a class of this embodiment, the frame is coated with a coating.

To accomplish above objective, one embodiment is as follows. A folding sport luggage comprises a main luggage case with wheels mounted on the bottom thereof. The rear portion of the main luggage case has a frame composed of side, back, bottom panels and is coated with a coating. The front portion of the main luggage case has a soft bag case extending from the frame of the main luggage case. The bottom panel has a folding structure comprising a folding front portion supporting the bottom of the soft bag case and a fixed rear portion supporting the bottom of the frame of the main luggage case. The fixed rear portion of the bottom panel has wheels mounted below.

Advantages of the invention are summarized below. The bottom panel of the main luggage case adopts means of folding, and with no items inside, the front portion of the luggage can be folded inwards to greatly reduce the space occupied by the sport luggage. Therefore, it is more convenient to place and transport. The related shipment and delivery costs lower simultaneously. Moreover, the front portion of the sport luggage has a supporting bottom panel.

DETAILED DESCRIPTION OF THE INVENTION

Figure 1:
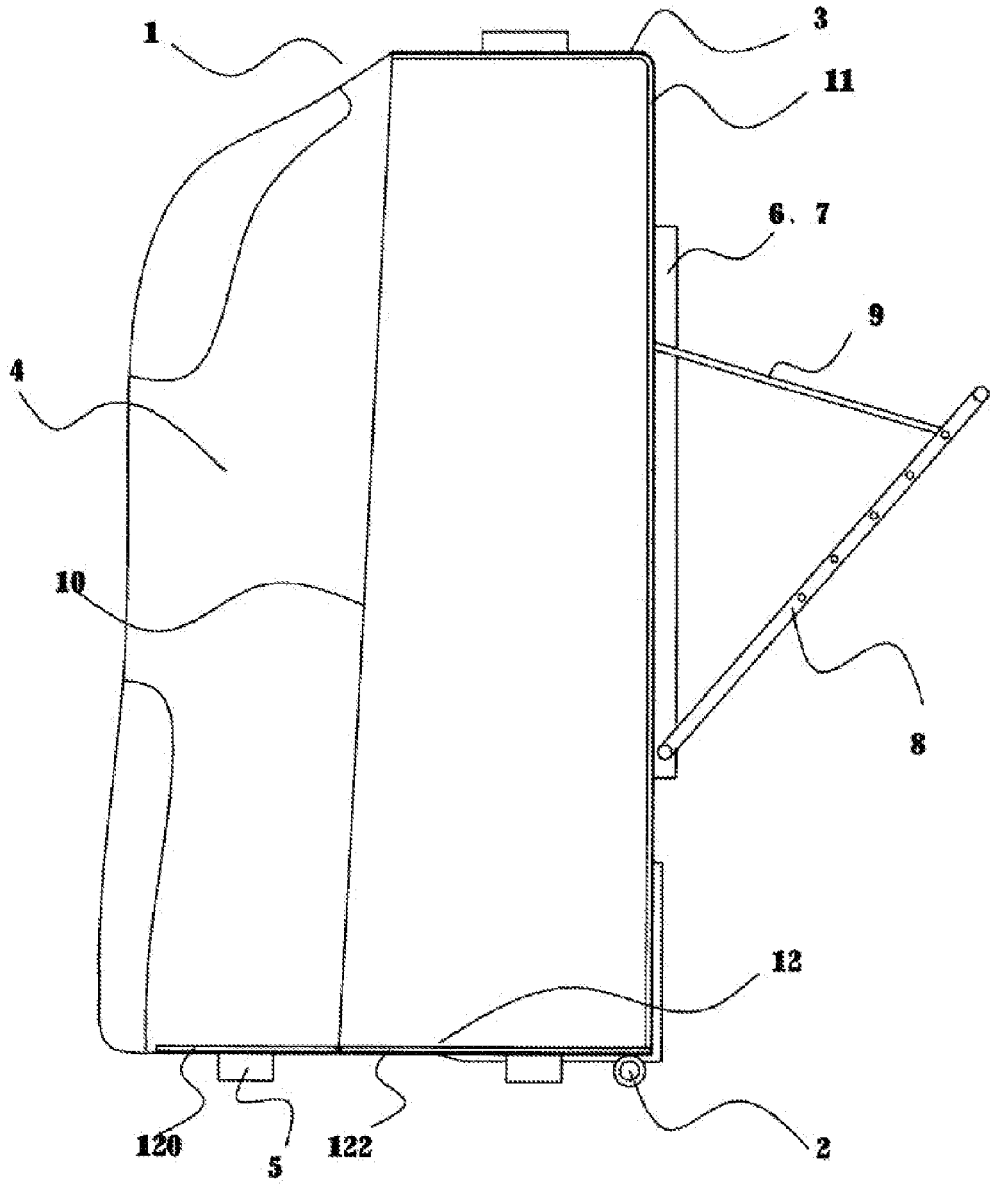
FIG. 1 shows a side view of a sport luggage in accordance with one embodiment of the invention.
Figure 2:
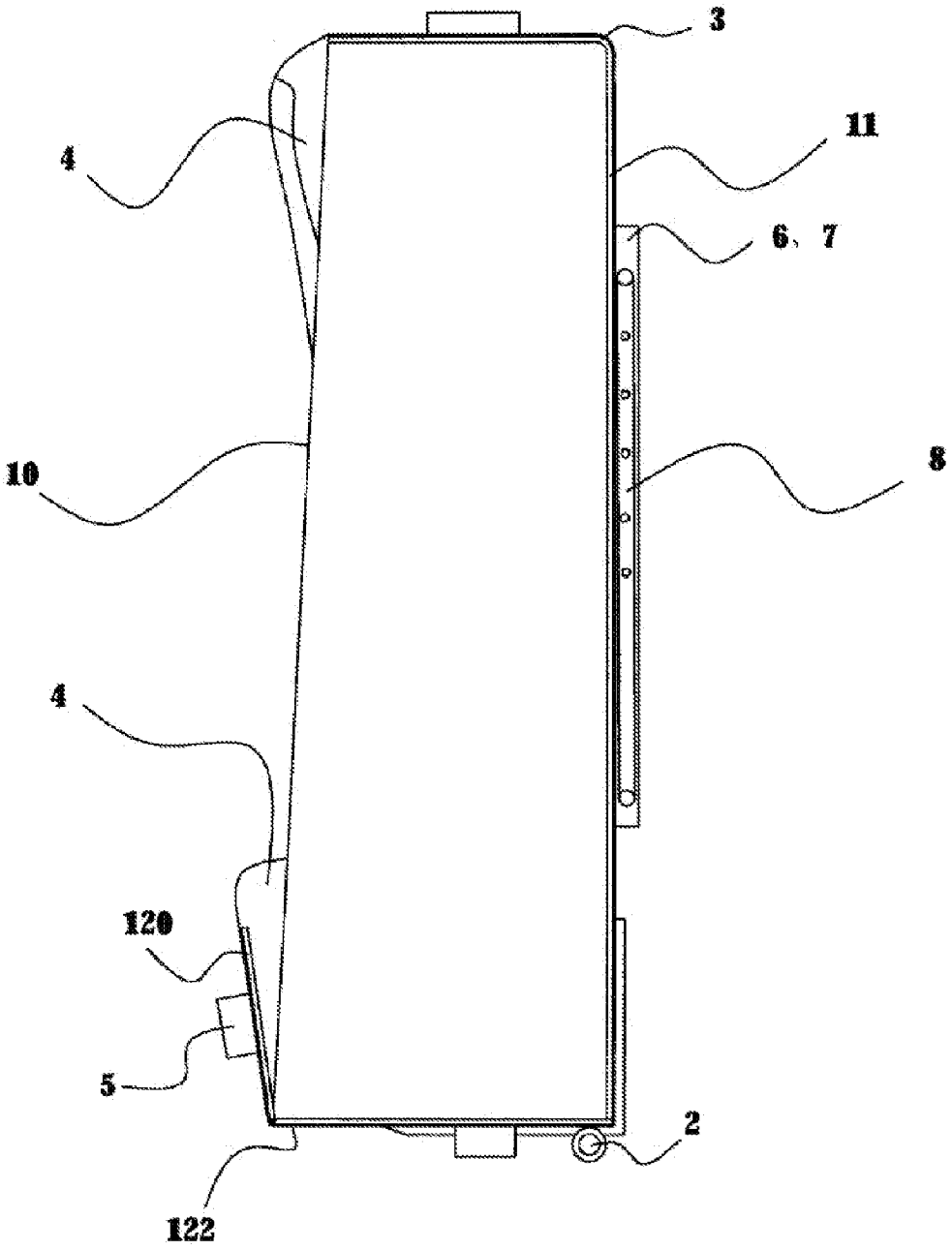
FIG. 2 shows a folding front portion being folded inwards in accordance with the embodiment of the invention.

As shown in FIGS. 1 and 2, a folding sport luggage comprises a main luggage case 1 with wheels 2 on the bottom thereof. The rear portion of the main luggage case 1 has a frame defined by a side panel 10, a back panel 11, and a bottom panel 12. The flame is coated with coating 3. The front portion of the main luggage case 1 has a soft bag case 4 extending from the frame of the main luggage case 1. The bottom panel 12 has a folding structure comprising a folding front portion supporting the bottom of the soft bag case 4 and a rear portion supporting the bottom of the frame of the main luggage case 1. The wheels 2 are mounted under the rear portion of the bottom panel 12.

In one embodiment, the bottom panel 12 comprises a folding front portion 120 and a fixed rear portion 122. The folding front portion 120 can be folded inwards.

Further, the folding front portion 120 is equipped with a support 5 below to ensure reliability.

In another embodiment, the front of the side panel 10 of the frame narrows inwards from the bottom up to ensure that the soft bag case 4 connecting with the frame can be put gradually inside the frame when the bottom panel is folded. Thus, the volume of sport luggage is reduced.

Figure 3:
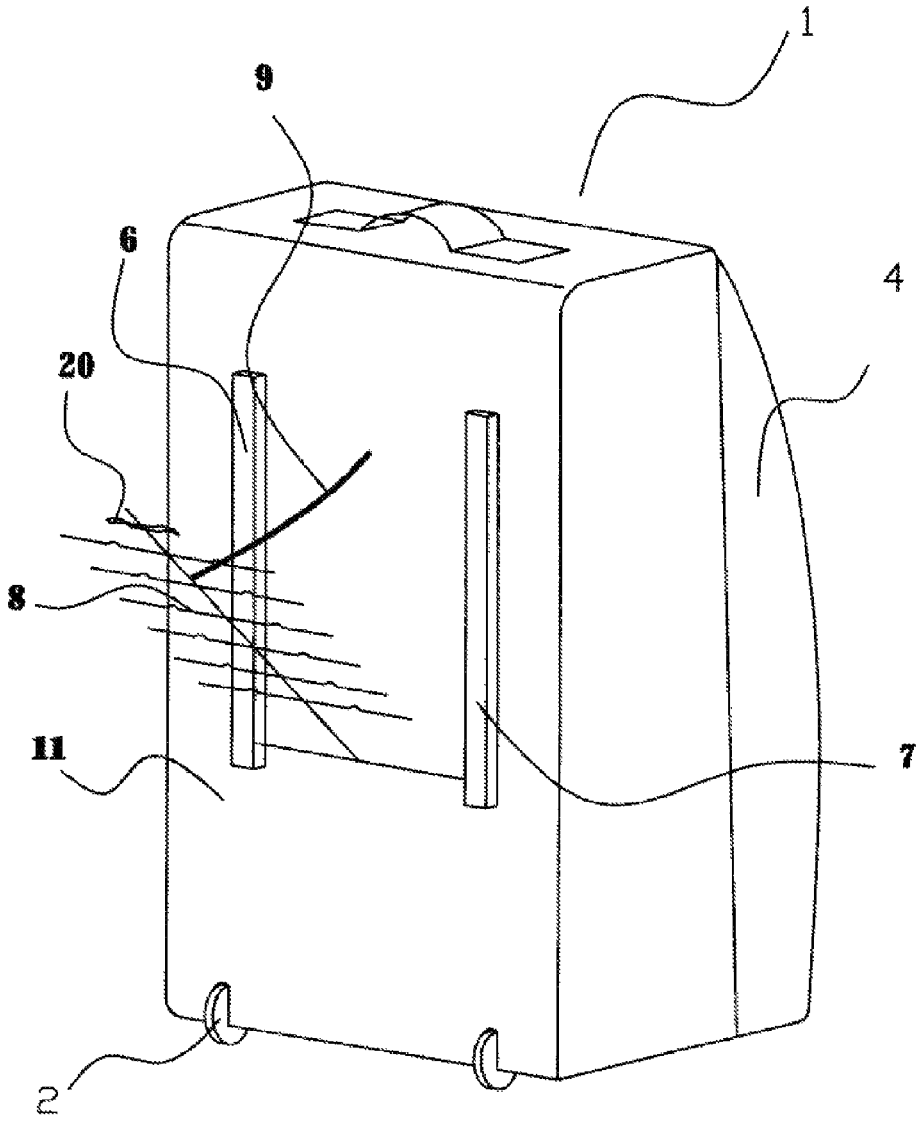
FIG. 3 is a rear view of a sport luggage in accordance with the embodiment of the invention.

As shown in FIG. 3, the opposite side of the back panel 11 of the frame of the main luggage case 1 is equipped with two parallel support slats 6, 7 and a hanging rack 8 hinged between the two support slats 6, 7. The lower end of the hanging rack 8 has a rotation structure and the upper end of the hanging rack 8 connects with the main luggage case 1 through a restraint string 9. When the hanging rack 8 is opened, it is convenient to hang towels thereof. When the hanging rack 8 is closed, it can be stuck firmly at the back of luggage by a fastening means, 20, for example, Velcro™.

The invention has been described with regard to one or more embodiments. However, it will be apparent to persons skilled in the art that a number of variations and modifications can be made without departing from the scope of the invention as defined in the claims.

The invention claimed is:

1. A folding sport luggage, comprising: a main luggage case; said main luggage case comprising a front portion and a rear portion; said rear portion comprising a frame having a bottom; said frame comprising a side panel, a back panel, and a bottom panel;

said front portion comprising a soft bag case having a bottom and extending from said frame; an outside of said back panel being equipped with two parallel support slats within the perimeter of said back panel and a hanging rack hinged between said two parallel support slats; said bottom panel comprising a folding structure; said folding structure comprising a folding front portion and a fixed rear portion; said folding front portion supporting said bottom of said soft bag case; said fixed rear portion having wheels mounted below; and said fixed rear portion supporting said bottom of said frame; wherein a lower end of said hanging rack has a rotation structure and an upper end of said hanging rack connects with said main luggage case through a restraint string.

* * * * *